US007868578B2

(12) United States Patent
Scheffknecht et al.

(10) Patent No.: US 7,868,578 B2
(45) Date of Patent: Jan. 11, 2011

(54) ARRANGEMENT COMPRISING ELECTRIC DRIVE UNITS FOR DRAWERS

(75) Inventors: Uwe Scheffknecht, Höchst (AT); Edgar Huber, Hard (AT)

(73) Assignee: Julius Blum GmbH, Hochst (AT)

( * ) Notice: Subject to any disclaimer, the term of this patent is extended or adjusted under 35 U.S.C. 154(b) by 343 days.

(21) Appl. No.: 12/222,993

(22) Filed: Aug. 21, 2008

(65) Prior Publication Data

US 2009/0206715 A1 Aug. 20, 2009

Related U.S. Application Data

(63) Continuation of application No. PCT/AT2007/000093, filed on Feb. 23, 2007.

(30) Foreign Application Priority Data

Mar. 3, 2006 (AT) ..... A 362/2006

(51) Int. Cl.
*G05G 5/00* (2006.01)

(52) U.S. Cl. ..... 318/626; 318/625; 318/646; 318/466; 318/468

(58) Field of Classification Search ..... 318/565, 318/625, 626, 646, 687, 689, 34, 38, 135, 318/430, 466, 467, 468; 312/319.5, 319.7, 312/319.8, 215
See application file for complete search history.

(56) References Cited

U.S. PATENT DOCUMENTS 5,014,875 A 5/1991 McLaughlin et al.
5,030,901 A * 7/1991 Futami ..... 318/610

(Continued)

FOREIGN PATENT DOCUMENTS

DE 88 02 655 7/1988

(Continued)

OTHER PUBLICATIONS

International Search Report issued Sep. 11, 2007 in the International (PCT) Application of which the present application is the U.S. National Stage.

(Continued)

*Primary Examiner*—Walter Benson
*Assistant Examiner*—Thai Dinh
(74) *Attorney, Agent, or Firm*—Wenderoth, Lind & Ponack, L.L.P.

(57) ABSTRACT

Disclosed is an assembly comprising at least two electric drive units (4) for respectively driving one of at least two drawers (2) which are movably mounted within a common furniture carcass (3). A measuring instrument (10) is assigned to each drive unit (4) in order to detect a force (F) that a user applies to the respective drawer (2). The inventive assembly further comprises at least one control or regulation device (9) for controlling or regulating the drive units (4). The measuring signals of the measuring instrument (10) can be fed to the control or regulation device (9) while the control or regulation device (9) can trigger the associated drive unit (4) after receiving a predetermined measuring signal from one of the measuring instruments (10). The control or regulation device (9) features a mode of operation in which the same prevents the drive units (4) allocated to the other measuring instruments (10) from being triggered after receiving the predetermined measuring signal from one of the measuring instruments (10).

8 Claims, 6 Drawing Sheets

U.S. PATENT DOCUMENTS

Figure 1A:
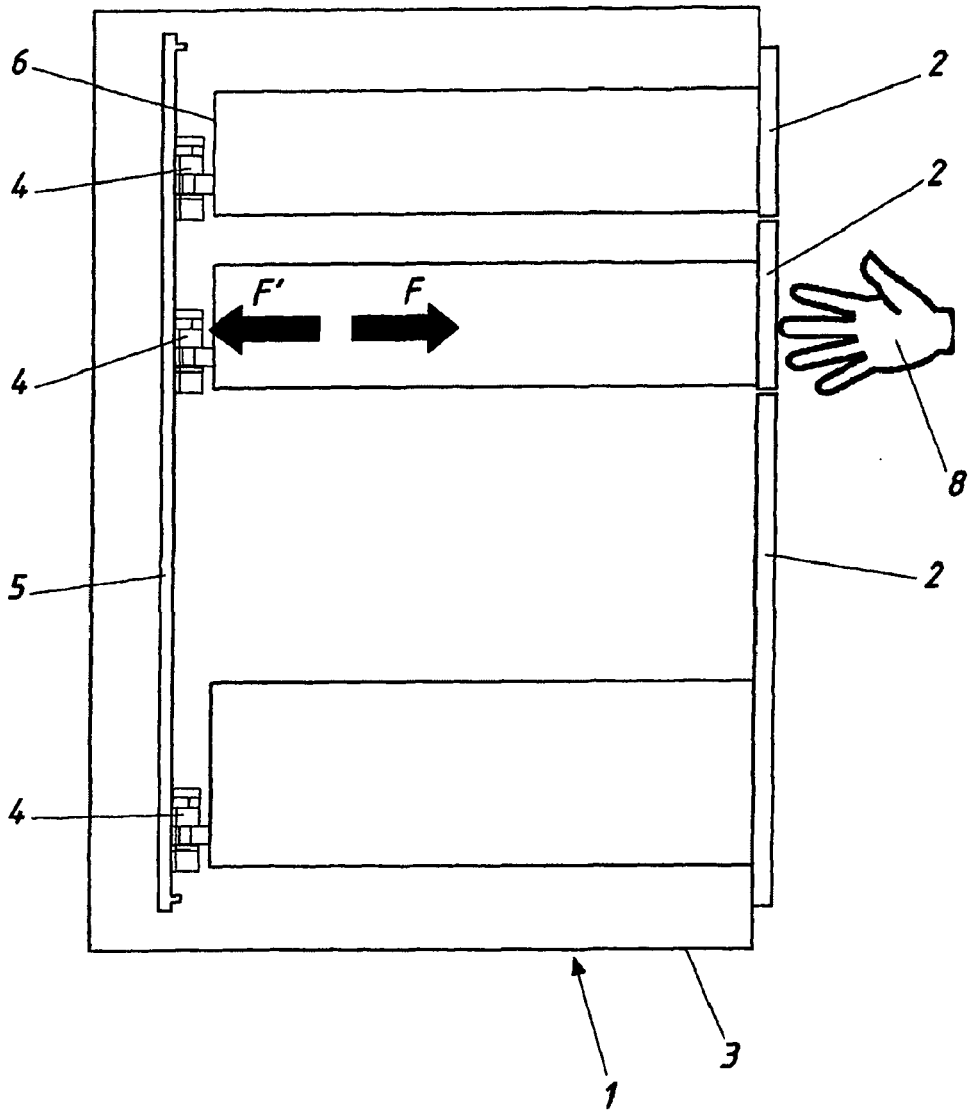

| | | | | |
|---|---|---|---|---|
| 5,087,107 | A * | 2/1992 | Fumanelli | 312/333 |
| 5,158,347 | A * | 10/1992 | Warren et al. | 312/319.8 |
| 5,392,951 | A * | 2/1995 | Gardner et al. | 312/319.5 |
| 7,282,884 | B2 * | 10/2007 | Huber et al. | 318/646 |
| 7,602,135 | B2 * | 10/2009 | Huber et al. | 318/651 |

FOREIGN PATENT DOCUMENTS

| | | |
|---|---|---|
| DE | 101 05 756 | 8/2001 |
| EP | 1 323 363 | 7/2003 |
| WO | 2004/100718 | 11/2004 |
| WO | 2006/017864 | 2/2006 |

OTHER PUBLICATIONS

Austrian Search Report issued Sep. 22, 2006 in the corresponding Austrian patent application.

* cited by examiner

ARRANGEMENT COMPRISING ELECTRIC DRIVE UNITS FOR DRAWERS

This application is a continuation of International Application No. PCT/AT2007/000093, filed Feb. 23, 2007, the disclosure of which is incorporated herein in its entirety.

The present invention concerns an arrangement comprising at least two electrical drive units for driving a respective one of at least two drawers mounted movably in a common body of an article of furniture, wherein associated with each drive unit is a measuring device for the detection of a force action exerted on the respective drawer by a user, and at least one control or regulating device for controlling or regulating the drive units, wherein the measurement signals of the measuring device can be fed to the control or regulating device and wherein after receiving the predetermined measurement signal from one of the measuring devices the control or regulating device can trigger the associated drive unit.

Arrangements of that kind frequently encounter the problem that, after triggering of one of the drive units has been effected, by virtue of the vibration triggered by that drive unit, unintentional triggering of other drive units occurs. The reason for this is that the vibration produced by the intentionally triggered drive unit is detected by the measuring devices of other drive units and is wrongly interpreted by the control or regulating device as a wish for actuation, in relation to the other drive units.

The electrical drive units are fixed in operation either directly to a rear wall of the body of the article of furniture or to a common carrier element. To avoid the problem of unintended triggering, the solution now adopted is that of making the rear wall of the furniture body or the common carrier element as rigid as possible. That is disadvantageous however for economic and technical reasons because of the increased weight and the fact that special rear walls or carrier elements have to be used.

The object of the invention is to provide an arrangement which can be fixed to conventional rear walls or carrier elements, while avoiding unintended triggering operations.

That object is attained by an arrangement having the features of claim 1.

The control or regulating unit blocks the other electrical drive units so-to-speak electronically, whereby they can also no longer be triggered by the vibration which occurs in operation of the intentionally triggered drive unit.

Further advantageous configurations are defined in the dependant claims.

By way of example, detection of a force action exerted on the respective drawer by a user can be effected in such a way that at least one of the measuring devices includes a position measuring device which is so arranged that a movement of the associated drawer out of the storage position in the furniture body can be detected by the position measuring device. The movement of the drawer out of the storage position can in that respect be either a movement into the furniture body or a movement out of the furniture body. Preferably the arrangement has both functionalities so that triggering of the drive unit can be effected equally by the drawer being pressed into the body of the article of furniture or by the drawer being moved out of the body of the article of furniture by a predetermined distance.

In that respect it is not absolutely necessary for the movement of the drawer to be measured directly. For example it can be provided that the position measuring device can detect the movement of a part of the drive unit, that is in contact with the associated drawer. That part can be for example an ejection lever of the drive unit, which is biased in the direction of the rear wall of the drawer by suitable means (for example a spring). When the drawer is pushed into the furniture body, the ejection lever is pushed in the direction of the rear wall of the furniture body by the rear wall of the drawer. When the drawer is pulled out of the furniture body somewhat, the ejection lever which is subjected to the mechanical biasing force can move somewhat further away from the rear wall of the furniture body. Both movements can be detected by the position measuring device and signaled to the control or regulating device.

It can admittedly be provided that for each article of furniture a single control or regulating device is responsible for all drive units arranged in the furniture body. A particularly preferred structure however is a modular structure in which each of the drive units has a control or regulating device which is preferably integrated in the housing. In that case it is provided that each of the control or regulating devices can be configured as a master. The other control or regulating devices function as slaves which take their orders from the master.

The invention also concerns an article of furniture comprising a furniture body and at least two drawers which are mounted movably in the furniture body, wherein the article of furniture has an arrangement in accordance with one of the above-described embodiments.

Figure 1B:
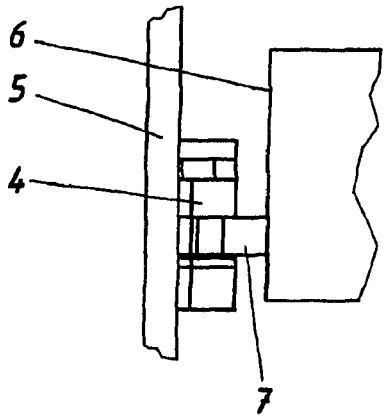
Figure 2A:
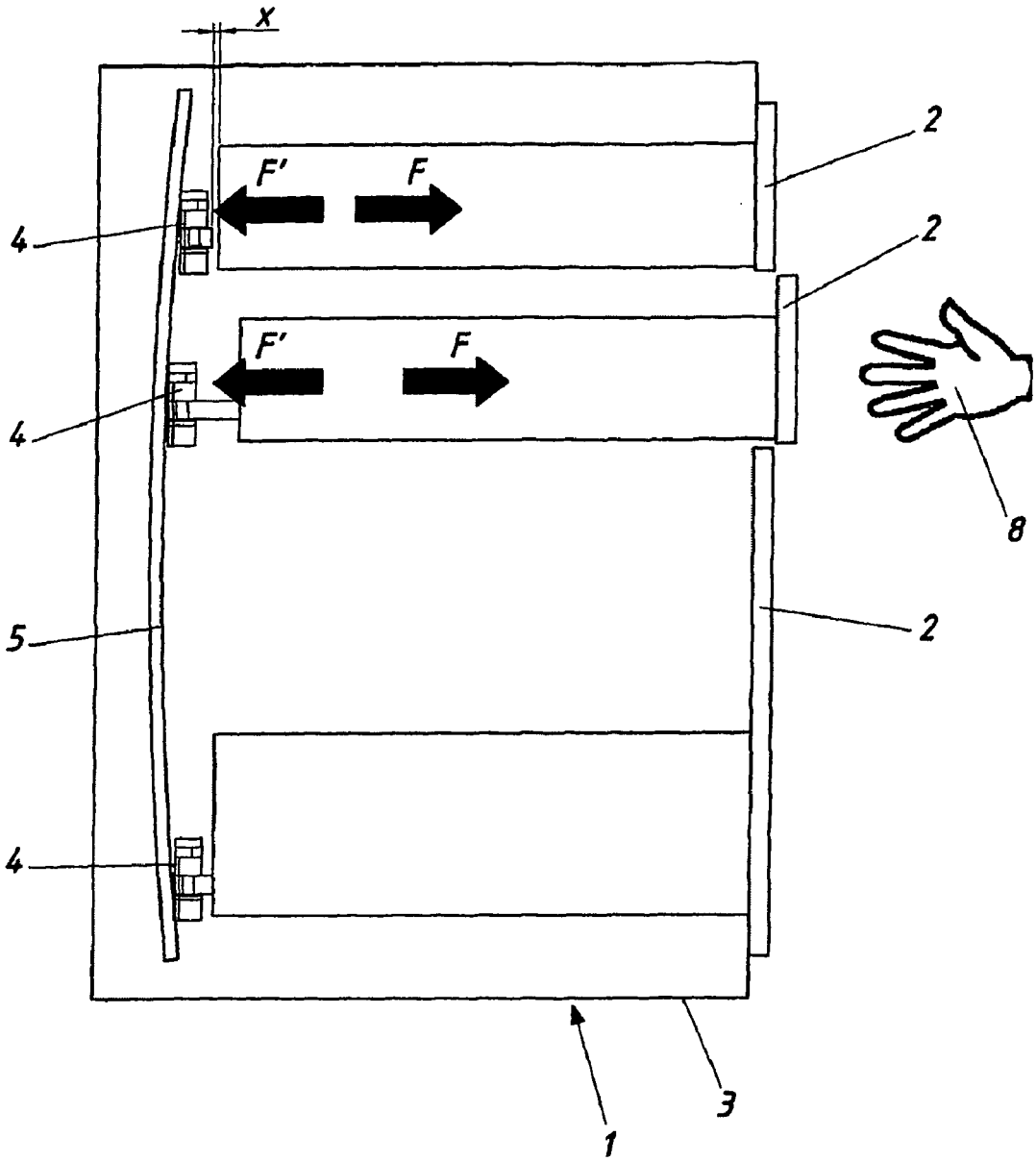
Figure 2B:
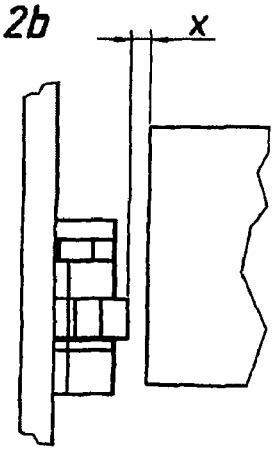
Figure 3:
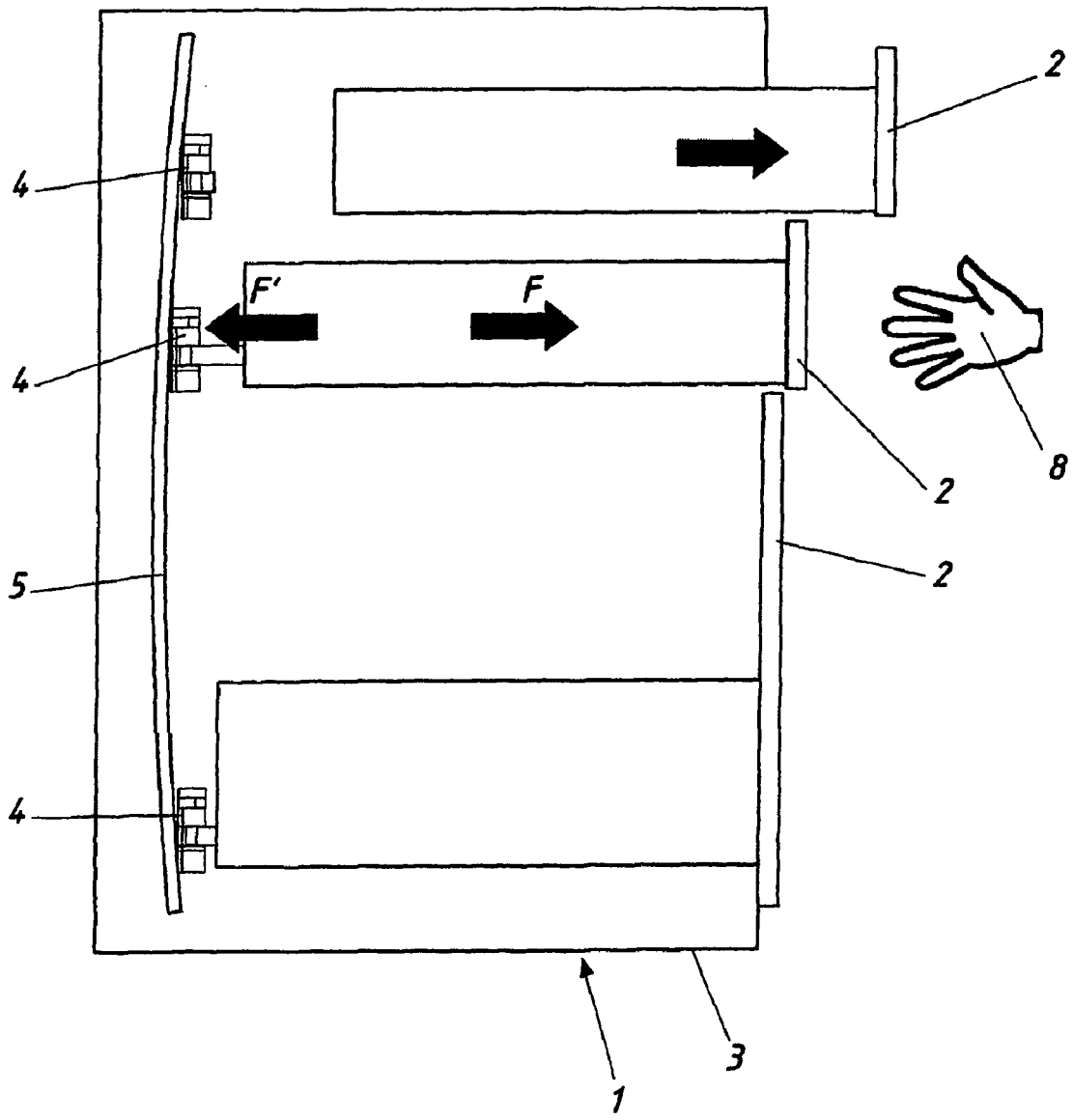
Figure 4:
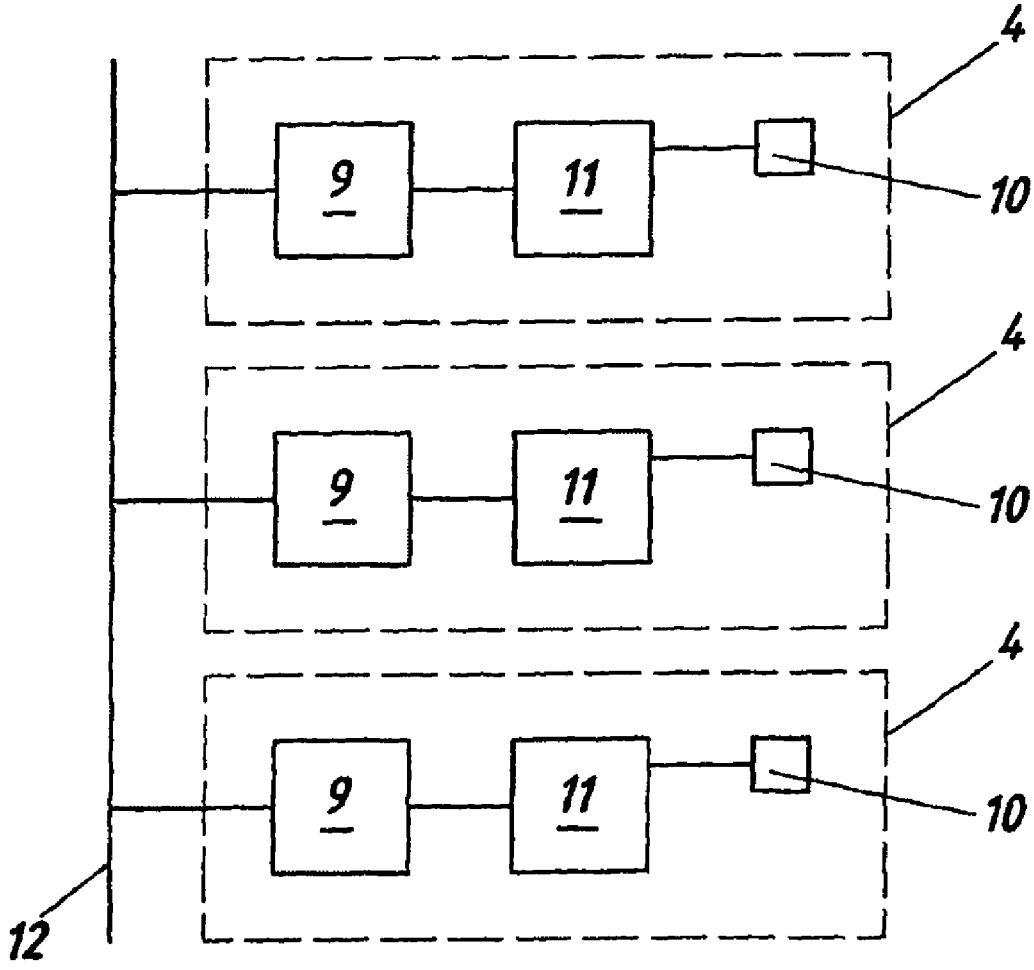
Figure 5A:
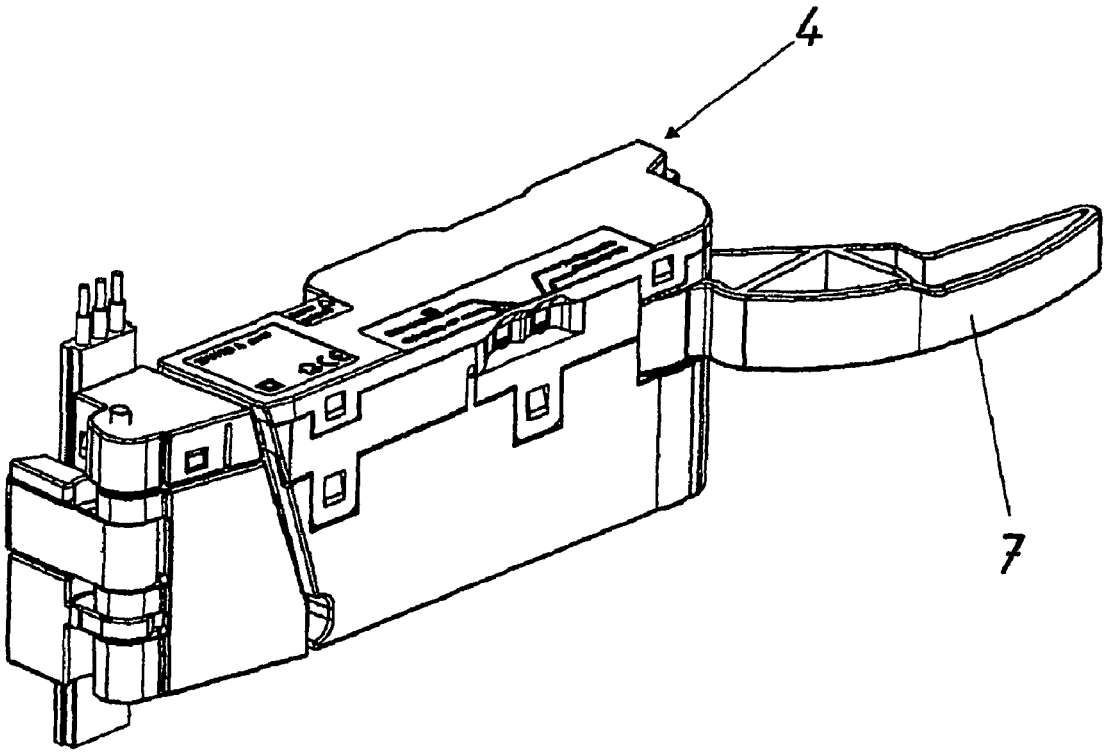
Figure 5B:
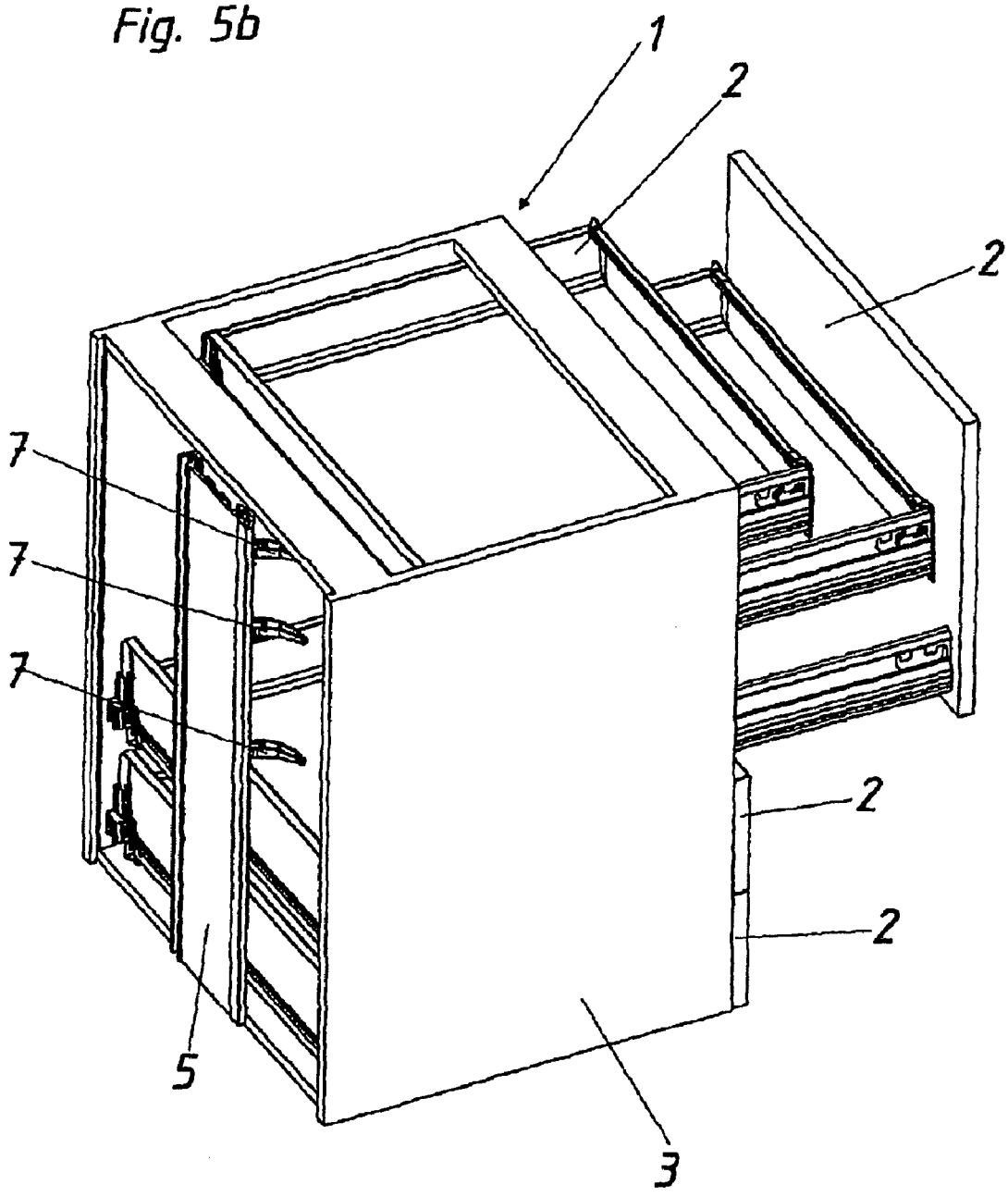

Further advantages and details of the invention will be apparent from the Figures and the related specific description. In the Drawings:

FIGS. 1*a* and 1*b* show a sectional view of an article of furniture with an arrangement in accordance with the state of the art and a detail view in relation thereto, FIGS. 2*a* and 2*b* show the article of furniture shown in FIGS. 1*a* and 1*b* after triggering of a drive unit, FIG. 3 shows the article of furniture shown in FIGS. 1*a*, 1*b* and FIGS. 2*a*, 2*b* at a later time, wherein unintentional triggering of a further drive unit can be seen therefrom, FIG. 4 shows a diagrammatic view of an arrangement according to the invention, and FIGS. 5*a* and 5*b* show a perspective view of a drive unit according to the invention and the arrangement thereof in a furniture body.

The problems of the arrangements belonging to the state of the art will be briefly described with reference to FIGS. 1 to 3.

FIG. 1*a* shows an article of furniture 1 with a furniture body 3 in which three drawers 2 are movably mounted. Four drive units 4 are fixed to a common carrier element 5. One of the drive units is shown in FIG. 1*b*. A user 8 would like to trigger the second drawer 2 from the top, by pushing it into the furniture body 3. In that situation, he applies the force F' to the drawer 2. By virtue of Newton's third law the ejection lever 7 of the drive unit 4 exerts an equal and opposite force F on the rear wall 6 of the drawer 2.

FIGS. 2*a* and 2*b* show that the application of force by the drive unit 4 to the intentionally triggered drawer 2 causes bending of the common carrier element 5, whereby the ejection lever 7 of the uppermost drive unit 4 moves away from the rear wall 6 of the uppermost drawer 2 by a distance X. That is wrongly interpreted by a control or regulating device (not shown in FIGS. 1 and 2) as a wish for actuation, so that this results in the situation shown in FIG. 3. Besides the intentionally triggered second drawer 2 from the top, the drive unit 4 of the uppermost drawer 2 was also unintentionally triggered.

FIG. 4 diagrammatically shows a particularly preferred embodiment of an arrangement according to the invention involving a modular structure. In that case each drive unit 4 has a control or regulating device 9, an electric motor 11 and a measuring device 10. The control or regulating devices 9 of the different drive units 4 communicate by way of a common data bus 12. The electric lines for supplying power to the individual units are not shown. One of the control or regulating units 9 is configured as a master and upon triggering of a drive unit 4 blocks the remaining drive units 4 for a predetermined time.

FIG. 5*a* shows a perspective view of a drive unit 4 which has an ejection lever 7 driven by an electric motor, for ejecting a drawer 2.

FIG. 5*b* shows an article of furniture 1, on the body 3 of which are arranged a plurality of drive units 4 with ejection levers 7.

The invention claimed is:

1. An arrangement comprising:

at least two electrical drive units for driving a respective one of at least two drawers mounted movably in a common body of an article of furniture, wherein associated with each drive unit is a measuring device for the detection of a force action exerted on the respective drawer by a user, and at least one control or regulating device for controlling or regulating the drive units, wherein the measurement signals of the measuring device can be fed to the control or regulating device and wherein after receiving the predetermined measurement signal from one of the measuring devices the control or regulating device can trigger the associated drive unit, wherein the control or regulating device has an operating mode in which after receiving the predetermined measurement signal from one of the measuring devices it blocks triggering of the drive units associated with the other measuring devices.

2. An arrangement according to claim 1, wherein at least one of the measuring devices includes a position measuring device which is so arranged that a movement of the associated drawer out of the storage position in the furniture body can be detected by the position measuring device.

3. An arrangement according to claim 1, wherein the movement of a part of the drive unit, that is in contact with the associated drawer, can be detected by the position measuring device.

4. An arrangement according to claim 3, wherein the part of the drive unit, that is in contact with the drawer, is in the form of an ejection lever.

5. An arrangement according to claim 1, wherein the control or regulating device is so adapted that it triggers the drive unit associated therewith upon an outward movement of the drawer out of the storage position in the furniture body by a predetermined distance.

6. An arrangement according to claim 1, wherein the control or regulating device is so adapted that it triggers the drive unit associated therewith upon an inward movement of the drawer out of the storage position in the furniture body by a predetermined distance.

7. An arrangement according to claim 1, wherein each of the drive units has a control or regulating device which is preferably integrated in the housing, wherein each control or regulating device can be configured as a master.

8. An article of furniture comprising a furniture body and at least two drawers mounted movably in the furniture body, characterised by an arrangement according to claim 1.

* * * * *